US009748690B2

(12) United States Patent
Sasaki

(10) Patent No.: US 9,748,690 B2
(45) Date of Patent: Aug. 29, 2017

(54) CONNECTOR

(71) Applicant: YAZAKI CORPORATION, Tokyo (JP)

(72) Inventor: Yasuhiro Sasaki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/202,296

(22) Filed: Jul. 5, 2016

(65) Prior Publication Data

US 2017/0012388 A1 Jan. 12, 2017

(30) Foreign Application Priority Data

Jul. 6, 2015 (JP) ..... 2015-134894

(51) Int. Cl.

*H01R 13/627* (2006.01)
*H01R 13/50* (2006.01)
*H01R 13/422* (2006.01)
*H01R 13/424* (2006.01)

(52) U.S. Cl.

CPC ..... *H01R 13/6272* (2013.01); *H01R 13/424* (2013.01); *H01R 13/4223* (2013.01); *H01R 13/50* (2013.01)

(58) Field of Classification Search

CPC ..... H01R 13/62; H01R 13/63; H01R 13/50; H01R 13/639; H01R 13/627
USPC ..... 439/353, 357, 358, 352, 373
See application file for complete search history.

(56) References Cited

U.S. PATENT DOCUMENTS 6,692,289 B2 * 2/2004 Nemoto ..... H01R 13/639 439/160
7,267,570 B2 * 9/2007 Fry, Jr. ..... H01R 13/6272 439/357
7,682,181 B1 * 3/2010 Jones, Jr. ..... H01R 13/6272 439/352
8,882,528 B2 * 11/2014 Sasho ..... H01R 13/6335 439/358
9,203,190 B2 * 12/2015 Hamai ..... H01R 13/6272
2001/0035652 A1 * 11/2001 Wada ..... C08J 9/0004 292/128
2002/0081912 A1 6/2002 Sakurai et al.
(Continued)

FOREIGN PATENT DOCUMENTS

GB 2 435 555 A 8/2007
JP 2002-170621 A 6/2002
(Continued)

OTHER PUBLICATIONS

Japanese Office Action for the related Japanese Patent Application No. 2015-134894 dated Apr. 25, 2017.

*Primary Examiner* — Alexander Gilman
(74) *Attorney, Agent, or Firm* — Kenealy Vaidya LLP

(57) ABSTRACT

A connector is provided with a connector housing including an elastic engagement arm as a part to be engaged with a mate connector serving as a mate to which the connector is fitted and a terminal accommodation chamber which accommodates therein a terminal of an electric wire having a terminal, and a rear holder including a holder side engagement part engaged with a housing side engagement part provided in the connector housing so as to be connected to the connector housing at a position of a rear end side in a fitting direction to the mate connector.

2 Claims, 9 Drawing Sheets

(56) References Cited

U.S. PATENT DOCUMENTS

| | | | | |
|---|---|---|---|---|
| 2002/0086588 | A1 | 7/2002 | Fujita | |
| 2005/0082840 | A1* | 4/2005 | Ichida | H01R 13/633 292/66 |
| 2006/0105611 | A1* | 5/2006 | Toyoda | H01R 13/6272 439/353 |

FOREIGN PATENT DOCUMENTS

| | | | |
|---|---|---|---|
| JP | 2007-227249 | A | 9/2007 |
| JP | 2013-246915 | A | 12/2013 |

* cited by examiner

CONNECTOR

CROSS REFERENCE TO RELATED APPLICATIONS

This application claims priority from Japanese Patent Application No. 2015-134894 filed on Jul. 6, 2015, the entire contents of which are incorporated herein by reference.

BACKGROUND OF THE INVENTION

Field of the Invention

The present invention relates to a connector having a rear holder connected to a connector housing at a position of a rear end side in a fitting direction to a mate connector serving as a mate to which the connector is fitted.

Description of Related Art

Usually, in the connector used for a wire harness which is arranged in, for instance, a motor vehicle, as an installation space of components of the motor vehicle tends to be small, a connector fitting operation to the mate connectormay sometimes possibly need to be carried out in a narrow space into which a hand is hardly inserted. Accordingly, a rear holder is used which is connected to the connector housing at the position of the rear end side of the fitting direction to the mate connector to obtain a function for preventing a terminal from slipping out from the connector housing so that the connector fitting operation to the mater connector may be easily carried out.

When the rear holder is used to carry out the connector fitting operation to the mate connector, an external force is applied to the rear holder. Thus, there is a fear that that a stress may be concentrated on a position where the rear holder is engaged with the connector housing to break the engaged position.

Accordingly, for instance, patent literature 1 discloses a connector which avoids a concentration of stress in an engaged position of a connector housing and a rear holder.

In the connector disclosed in the patent literature 1, under a connected state of the connector housing and the rear holder, the rear holder is attached between connecting walls and the connecting walls are respectively engaged with each other by engagement protrusions fitted to engagement holes and abutting protrusions abutting on peripheral edges of the connecting walls, so that the connecting walls can be engaged in a plurality of positions. Thus, the concentration of stress can be avoided in the engaged position of the connector housing and the rear holder.

Further, in such a connector, the connector housing is frequently used which includes an elastic engagement arm that is a part engaged with a mate connector as a mate to which the connector is fitted and terminal accommodation chambers which accommodate therein terminals of electric wires having terminals. As for the elastic engagement arm, the electric wire of the electric wire having the terminal is liable to be caught in the elastic engagement arm. As a result, there is a fear that the elastic engagement arm may be possibly broken.

Accordingly, patent literature 2 discloses a connector which can prevent an electric wire from being caught in a lock arm (an elastic engagement arm).

The connector disclosed in the patent literature 2 has a protruding piece located between the lock arm (the elastic engagement arm) and an electric wire taking out surface and protruding rearward, and a rear end of the protruding piece is located in a part more rearward than a rear end of the lock arm (the elastic engagement arm) and the electric wire taking out surface. Thus, the electric wire interferes with the protruding piece to prevent the electric wire from moving round to the lock arm (the elastic engagement arm) side.

[Patent Literature 1] JP-A-2007-227249

[Patent Literature 1] JP-A-2013-246915

However, in the connector disclosed in the patent literature 1, when the connector is pushed in the fitting direction to fit the connector to the mate connector, since a jig or the like is pressed to the rear holder protruding rearward from the rear end of the connector housing to push in the connector, a load applied to the engaged position part is dispersed. However, the load is liable to be applied to the engaged position, so that there is a fear that the engaged position may be probably broken.

Further, in the connector disclosed in the patent literature 2, since the protruding part serving as a wall for protecting the lock arm (the elastic engagement arm) protrudes toward an insert opening side of a terminal, a problem arises that the protruding part interferes with the terminal when the terminal is inserted into a terminal accommodation chamber, and accordingly, the terminal is hardly smoothly inserted into the terminal accommodation chamber.

The present invention devised by considering the above-described circumstances, and it is an object of the present invention to provide a connector which can prevent an elastic engagement arm as a part engaged with a mate connector and an engaged part of a connector housing and a rear holder from being broken and makes it possible to smoothly insert a terminal into a terminal accommodation chamber.

SUMMARY

In accordance with one or more embodiments, a connector is provided with a connector housing including an elastic engagement arm as a part to be engaged with a mate connector which is a mate to which the connector is fitted, a terminal accommodation chamber which accommodates therein a terminal of an electric wire having the terminal, and a housing side engagement part. The connector is further provided with a rear holder including a holder side engagement part engaged with the housing side engagement part so as to be connected to the connector housing at a position of a rear end side in a fitting direction to the mate connector. The connector housing includes with a rear extending part having a rear end surface and a terminal guide surface. The rear end surface is possible to be pressed toward the fitting direction and protrudes more rearward in the fitting direction than the rear holder from a position which shifts in a direction intersecting at substantially right angles to the fitting direction relative to the housing side engagement part. The terminal guide surface is configured to prevent the electric wire from coming into contact with the elastic engagement arm and guides the terminal to the terminal accommodation chamber from a side of the rear end surface.

In accordance with one or more embodiments, the rear extending part in the above-described invention includes an extending wall which is extended rearward in the fitting direction from an inner wall surface of the terminal accommodation chamber. The terminal guide surface is a surface continuous to the inner wall surface of the extending wall. The elastic engagement arm includes an elastic arm and an engagement releasing operation part. The elastic arm is formed in a back side to the terminal guide surface of the extending wall and protrudes in a shape of an arm on an outer surface of the connector housing so as to direct an end forward in the fitting direction. The engagement releasing operation part includes a jig insert hole formed in the elastic arm in which an engagement releasing jig is inserted in order to elastically bend the elastic arm and release an engagement to the mate connector. The rear extending part includes a jig guide part having a jig guide surface which is made from an extension part which extends the elastic arm more rearward from the engagement releasing operation part in the fitting direction and which guides the engagement releasing jig from the rear end surface to the jig insert hole.

Advantages of the Invention

According to one or more embodiments, since the rear end surface for the pressing operation protrudes more rearward in the fitting direction than the rear holder connected to the connector housing from the position which shifts substantially in the direction intersecting at right angles to the fitting direction relative to the housing side engagement part, when the external force in the fitting direction is applied to the rear end surface 20*a* for the pressing operation, the external force is hardly applied to the engaged part of the connector housing and the rear holder. Thus, when the connector is pushed in the fitting direction the engaged part of the connector housing and the rear holder can be prevented from being broken. Further, since the electric wire of the electric wire having the terminal can be prevented from coming into the elastic engagement arm and the terminal can be guided to the terminal accommodation chamber from the rear end surface side for the pressing operation by the terminal guide surface at the same time, the elastic engagement arm as the engaged part of the mate connector and the engaged part of the connector housing and the rear holder can be prevented from being broken. Further, the terminal can be smoothly inserted into the terminal accommodation chamber.

Further, one or more embodiments can provide both a function of preventing the electric wire from coming into contact with the elastic engagement arm by the extending wall which has the inner wall surface of the terminal accommodation chamber extending rearward in the fitting direction and a guide function of the terminal. Further, since the end of the engagement releasing jig can be guided by and moved on the jig guide surface toward the jig insert hole of the engagement releasing operation part from the rear end of the rear extending part protruding rearward in the fitting direction, an operation for releasing the engagement of the mate connector with the elastic engagement arm can be easily carried out by the engagement releasing jig.

DETAILED DESCRIPTION

Figure 1:
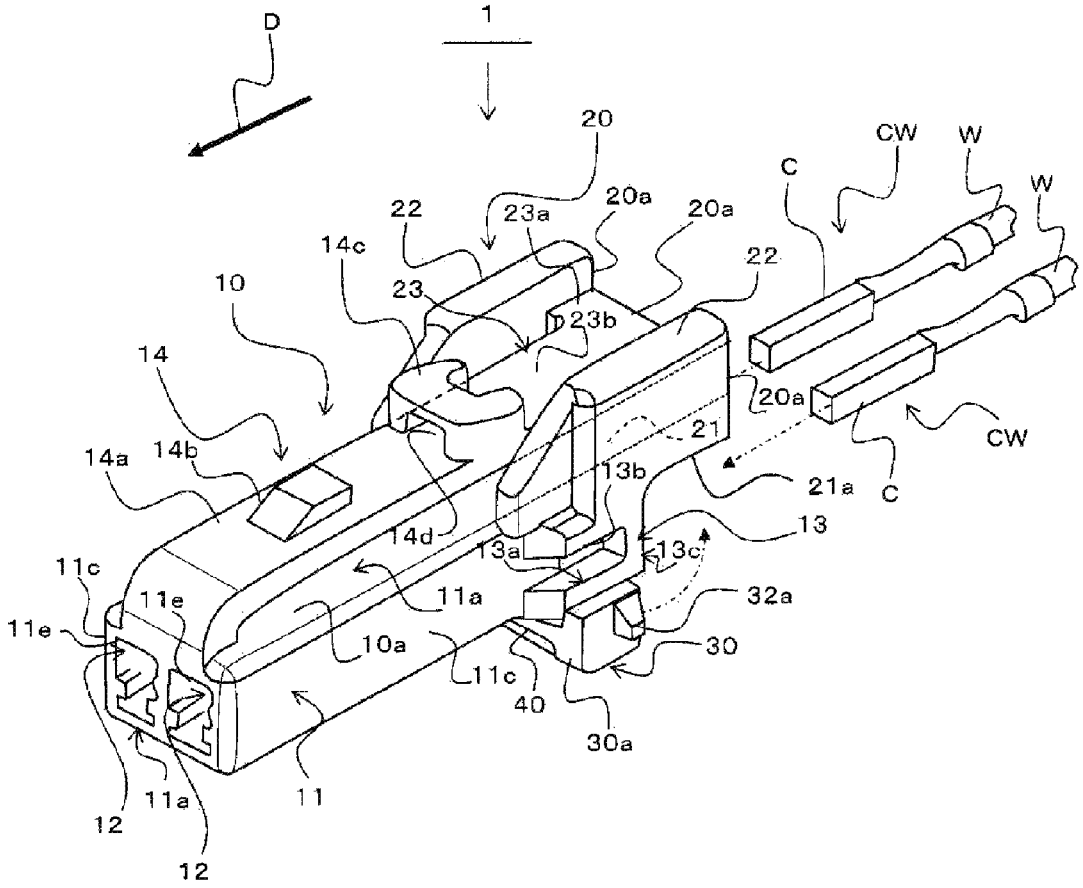
FIG. 1 is a perspective view showing a state before terminals of electric wires having terminals are fitted to a connector housing of a connector according to an exemplary embodiment of the present invention.

Now, by referring to the drawings, a preferred exemplary embodiment of a connector according to the present invention will be described below in detail.

Exemplary Embodiment

Figure 2:
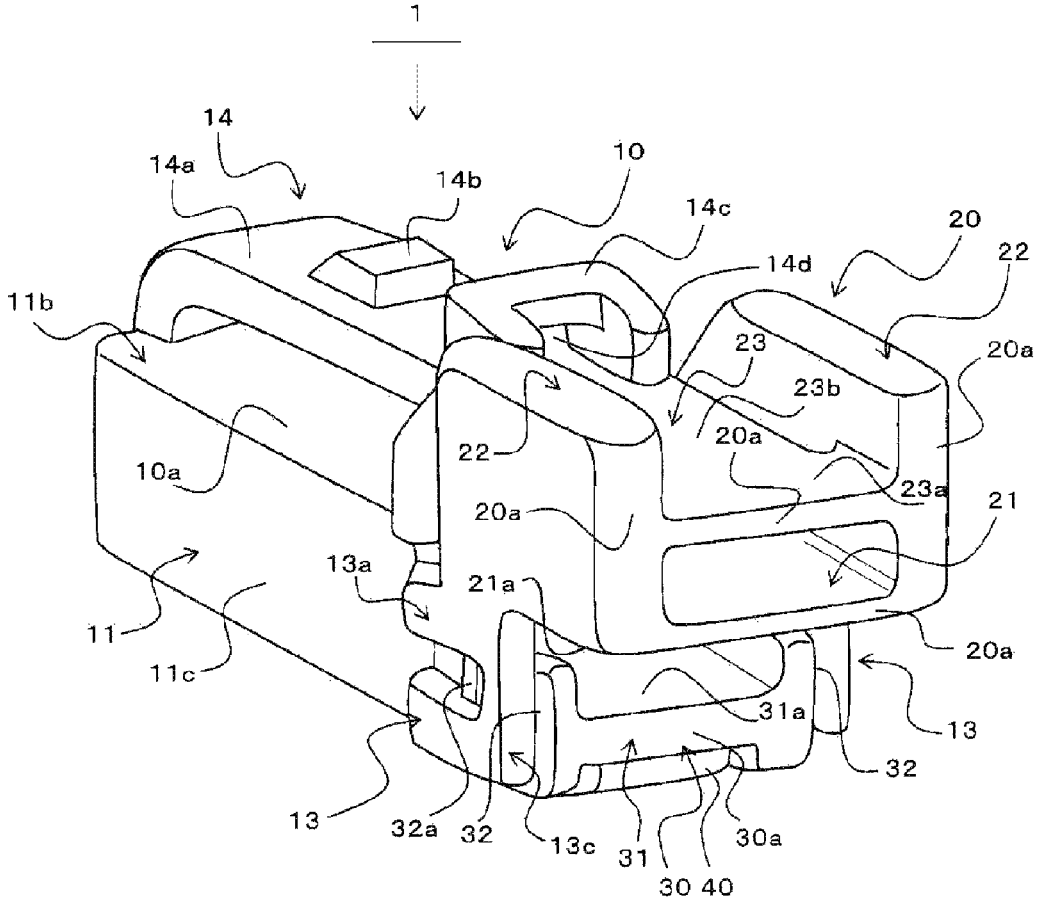
FIG. 2 is a perspective view which views from a rear end side the connector under a state that a housing side engagement part is engaged with a holder side engagement part to connect a rear holder to the connector housing at a position of a rear end side of a fitting direction to a mate connector.
Figure 3A:
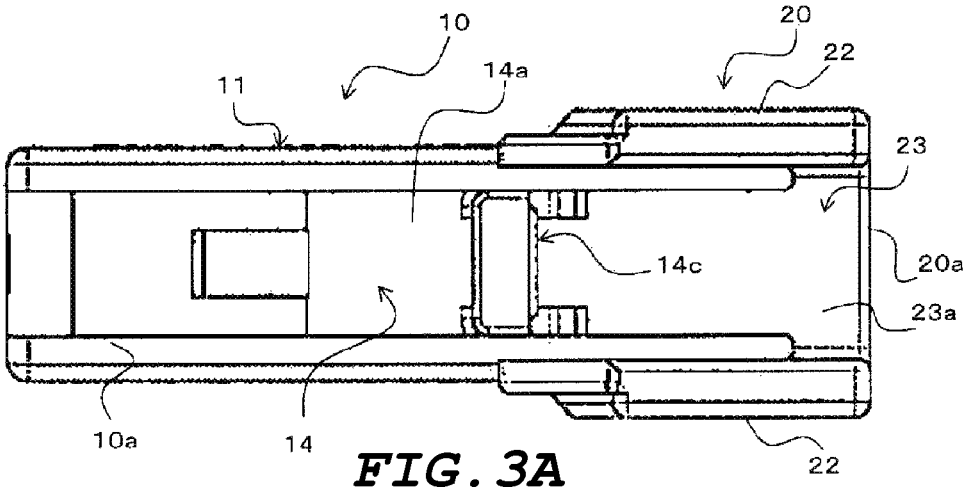
FIG. 3A is a top view of the connector housing.
Figure 3B:
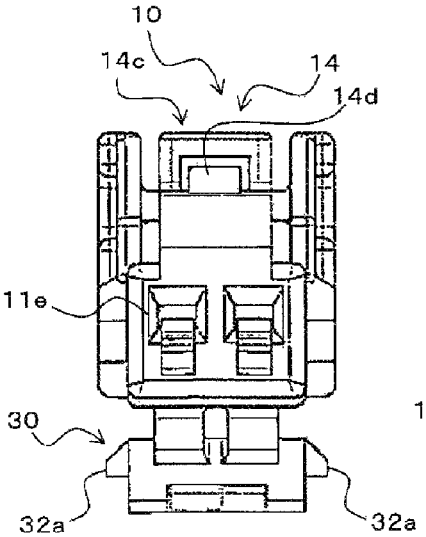
FIG. 3B is a front view of the connector housing.
Figure 3C:
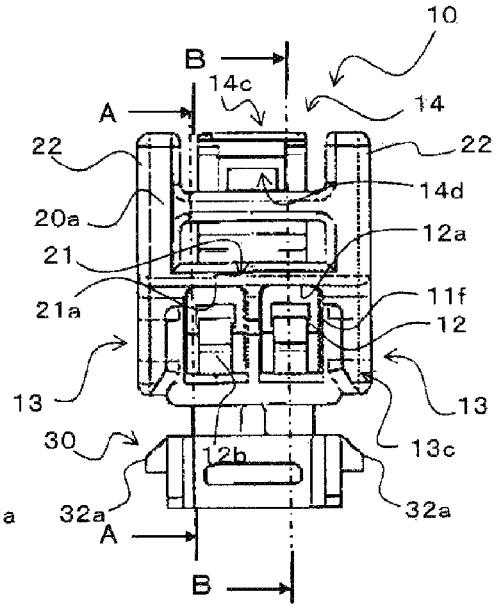
FIG. 3C is a rear view of the connector housing.
Figure 4:
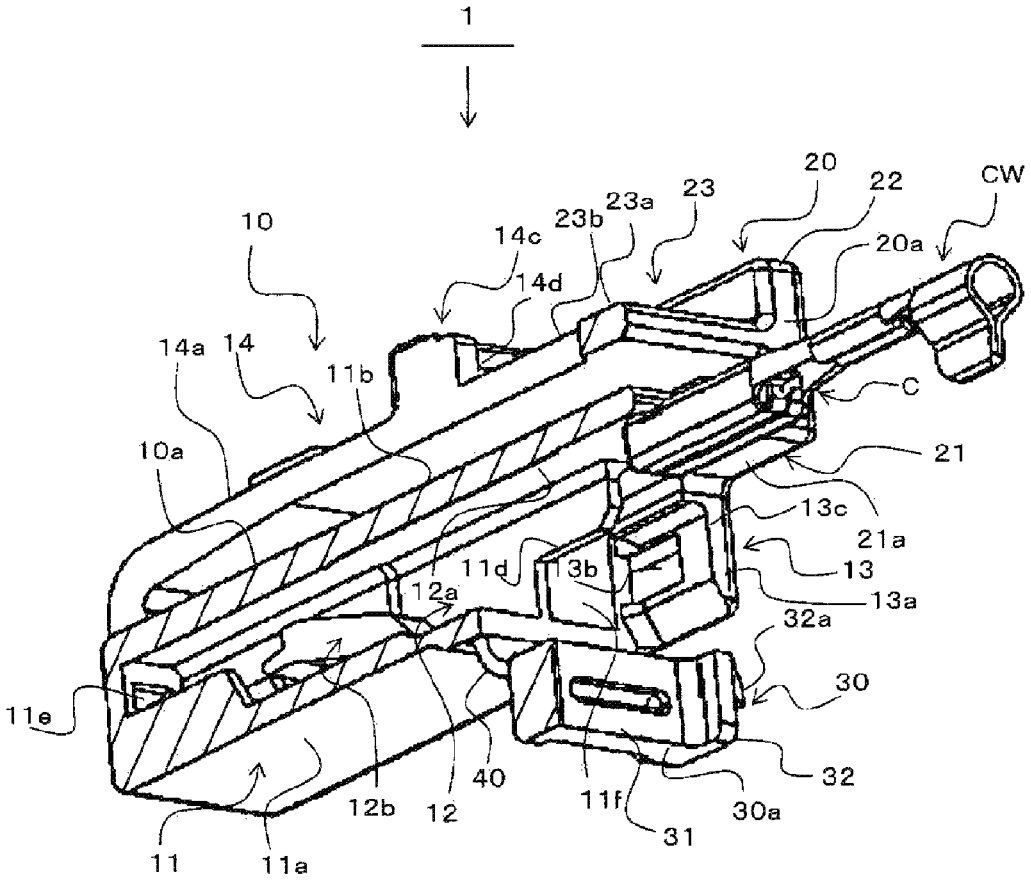
FIG. 4 is a perspective view of the connector housing in a section taken along a line A-A shown in FIG. 3C.
Figure 5:
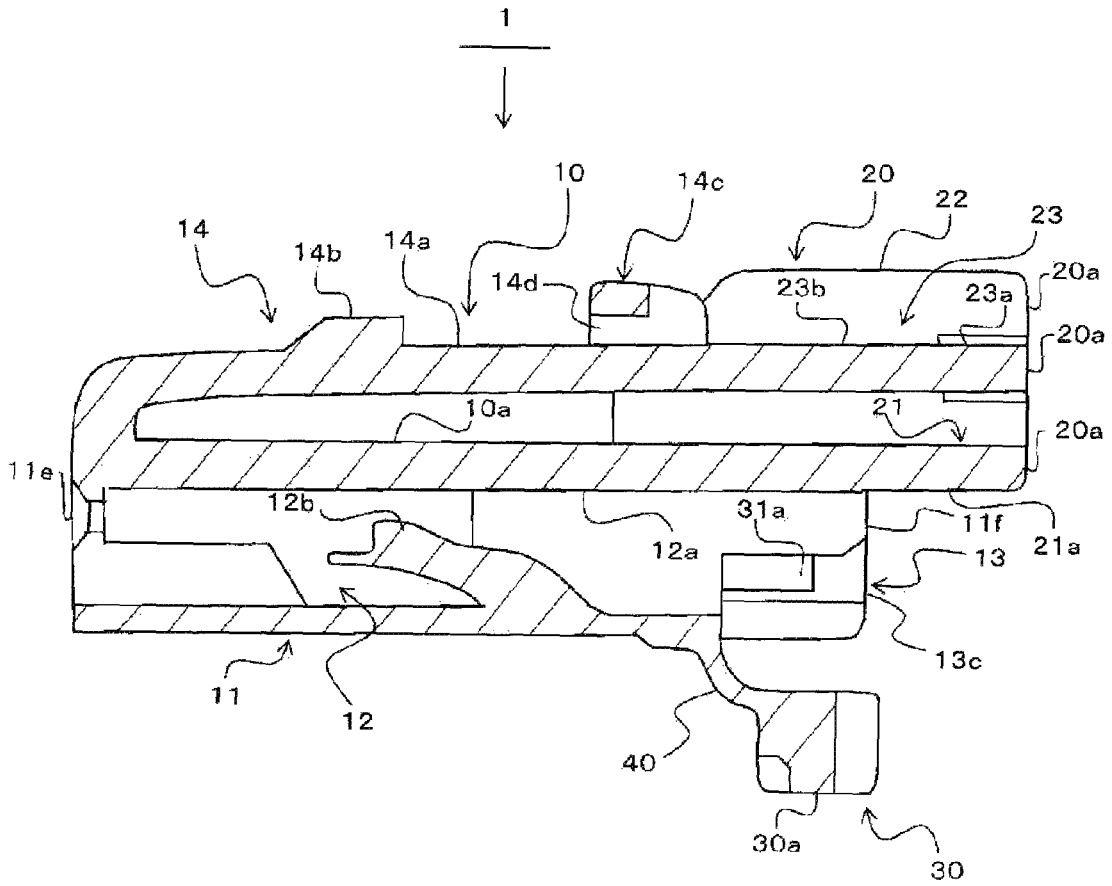
FIG. 5 is a sectional view of the connector housing taken along a line B-B shown in FIG. 3C.

FIG. 1 is a perspective view showing a state before terminals C of electric wires CW having terminals are fitted to a connector housing 10 of a connector 1 *a* according to an exemplary embodiment of the present invention. FIG. 2 is a perspective view which views from a rear end side the connector under a state that a housing side engagement part 13 is engaged with a holder side engagement part 32*a* to connect a rear holder 30 to the connector housing 10 at a position of a rear end side of a fitting direction to a mate connector 100. FIG. 3A is a top view of the connector housing 10. FIG. 3B is a front view of the connector housing 10. FIG. 3C is a rear view of the connector housing 10. FIG. 4 is a perspective view of the connector housing 10 in a section taken along a line A-A shown in FIG. 3C. FIG. 5 is a sectional view of the connector housing 10 taken along a line B-B shown in FIG. 3C.

The connector 1 according to the exemplary embodiment of the present invention is used in a wire harness arranged in, for instance, a motor vehicle. The connector 1 includes the connector housing 10 having an elastic engagement arm 14 as a part to be engaged with the mate connector 100 serving as a mate to which the connector is fitted and terminal accommodation chambers 12 which accommodate therein the terminals C of the electric wires CW having the terminals and the rear holder 30 connected to the connector housing 10 in such a way that the holder side engagement part 32*a* is engaged with the housing side engagement part 13 provided in the connector housing 10 at the position of the rear end side of the fitting direction to the mate connector 100.

Initially, the connector housing 10 will be described below.

The connector housing 10 is formed with, for instance, an insulating synthetic resin material. The connector housing 10 includes a housing main body part 11 forming a main body part, the housing side engagement part 13 to be engaged with the holder side engagement part 32*a* of the rear holder 30, the elastic engagement arm 14 and a rear extending part 20 having a rear end surface 20*a* formed for a pressing operation which can be pressed toward the fitting direction.

The housing main body part 11 is configured substantially in a rectangular tube which has a bottom wall 11*a*, a top wall 11*b* opposed to the bottom wall 11*a* and one pair of side walls 11*c* and 11*c* opposed to each other. An inner part is divided by a partition wall 11*d* to provide the two terminal accommodation chambers 12 which accommodate the terminals C of the two electric wires CW having the terminals.

The housing main body part 11 is provided with two mate terminal insert openings 11*e* in a front end surface in the fitting direction. The two mate terminal insert openings 11*e* are openings formed so as to insert two terminals not shown in the drawing and accommodated in the mate connector 100 respectively and connect the terminals to the two terminals C respectively accommodated in the connector housing 10 under a state that the connector 1 is fitted to the mate connector 100.

Further, the housing main body part 11 is provided with two terminal insert openings 11*f* as openings for inserting the two terminals C of the electric wires having the terminals into the terminal accommodation chambers 12 in a rear end surface in the fitting direction.

As shown in FIG. 4 and FIG. 5, in the terminal accommodation chambers 12, engagement lances 12*b* are respectively provided and the terminals C are respectively engaged therewith in prescribed positions in the terminal accommodation chambers 12.

The housing side engagement part 13 has one pair of engagement wall parts 13*a* and 13*a* provided in such a way that the engagement wall parts 13*a* and 13*a* are connected to outer wall surface sides of rear end parts of the one pair of side walls 11*c* and 11*c* so as to be opposed to each other with a space provided enough to fit the rear holder 30 between them.

In the engagement wall parts 13*a* and 13*a*, engagement holes 13*b* are respectively formed with which below-described engagement protrusions 32*a* of the rear holder 30 are engaged.

The elastic engagement arm 14 includes an elastic arm 14*a* protruding in the form of an arm on an outer surface 10*a* of the connector housing 10 so as to direct an end forward in the fitting direction, an engagement protrusion 14*b* provided on the elastic arm 14*a* so as to be engaged with the mate connector 100 in a fitting position of the connector and an engagement releasing operation part 14*c* having on the elastic arm 14*a* a jig insert hole 14*d* formed for inserting an engagement releasing jig T which is formed so that the elastic arm 14*a* may be elastically bent to release an engagement of the mate connector 100 by the engagement protrusion 14*b*.

The elastic engagement arm 14 is provided in a back side to a below-described terminal guide surface 21*a* of an extending wall 21.

A rear extending part 20 protrudes more rearward in the fitting direction than the rear holder 30 from a position which shifts substantially in a direction intersecting at right angles to a fitting direction D relative to the housing side engagement part 13. Thus, a rear end surface 20*a* for a pressing operation is formed which can be pressed toward the fitting direction D. Further, the terminal guide surface 21*a* serving as a surface is formed which prevents the electric wires W of the electric wires CW having the terminals from coming into contact with the elastic engagement arm 14 and guides the terminals C to the terminal accommodation chambers 12 from the rear end surface 20*a* side for the pressing operation.

The rear extending part 20 includes an extending wall 21 which has an inner wall surface 12*a* of the terminal accommodation chamber 12 extending rearward in the fitting direction.

The terminal guide surface 21*a* is formed on a surface continuous to the inner wall surface 12*a* of the extending wall 21.

Namely, the extending wall 21 forms the terminal guide surface 21*a* for inserting each terminal C to the corresponding terminal accommodation chamber 12.

More specifically, the extending wall 21 is a wall which extends the top wall 11*b* of the housing main body part 11 rearward in the fitting direction so that the terminal guide surface 21*a* may extend rearward the inner wall surface 12*a* of each terminal accommodation chamber 12.

Further, the rear extending part 20 is provided with walls 22 and 22 which form the rear end surface 20*a* for the pressing operation on a back side surface to the terminal guide surface 21*a* of the extending wall 21.

More specifically, the rear extending part 20 allows one pair of reinforcing ribs 22 and 22 to stand upright along both side edges of the extending wall 21 as the walls which form the rear end surface 20*a* for the pressing operation on the back side surface of the terminal guide surface 21*a* of the extending wall 21.

The above-described rear extending part 20 includes the extending wall 21, the one pair of reinforcing ribs 22 and 22 which stand upright along both the side edges of the extending wall 21 in such a way that the reinforcing ribs 22 and 22 are partly built on the housing main body part 11 and a jig guide part 23 having a jig guide surface 23*b* formed between the one pair of reinforcing ribs 22 and 22 which guides the engagement releasing jig T to the jig insert hole 14*d* from the rear end surface 20*a* side for the pressing operation.

The jig guide part 23 forms the jig guide surface 23*b* which guides the engagement releasing jig T to the jig insert hole 14*d* from the rear end surface 20*a* side for the pressing operation by a part formed by extending the elastic arm 14*a* more rearward in the fitting direction from the engagement releasing operation part 14*c*.

In the above-described jig guide part 23, an extending end 23*a* is fixed so as to build a bridge between surfaces of the one pair of reinforcing ribs 22 and 22 which face each other.

Accordingly, a continuing space from a base end part of the elastic arm 14*a* to the extending end 23*a* of the jig guide part 23 is held with a space provided from the top wall 11*b*. Thus, the continuing block from the base end part of the elastic arm 14*a* to the extending end 23*a* of the jig guide part 23 can be easily bent toward the top wall 11*b*.

In the rear extending part 20, the extending wall 21, the one pair of reinforcing ribs 22 and 22 and the jig guide part 23 respectively form the rear end surfaces 20*a* for the pressing operation, so that the rear end surface 20*a* for the pressing operation is increased in the direction intersecting at right angles to the fitting direction D.

Namely, the rear extending part 20 uses the rear end surfaces of the extending wall 11, the one pair of reinforcing ribs 22 and 22 and the jig guide part 23 respectively to increase the rear end surface 20*a* for the pressing operation.

Further, the rear extending part 20 provides the rear end surface 20*a* for the pressing operation which is formed with a wall having a square shape in section by the extending wall 21, the one pair of reinforcing ribs 22 and 22 and the extending end 23*a* as an end part of a part formed by extending the elastic arm 14*a* rearward in the fitting direction. Accordingly, the rear extending part 20 has a structure high in its rigidity.

Now, the rear holder 30 will be described below.

The rear holder 30 is formed with, for instance, an insulating synthetic resin material and is connected to the connector housing 10 at a position of a rear end side of the housing main body part 11. Thus, the terminal C accommodated in the terminal accommodation chamber 12 is pressed to prevent the terminal C from slipping out from the connector housing 10. Namely, the rear holder 30 has a function for doubly engaging the terminal C in the terminal accommodation chamber 12 together with the engagement lance 12*b* provided in the terminal accommodation chamber 12.

The rear holder 30 includes a holder bottom wall 31 having a terminal pressing surface 31*a* serving as a surface formed which presses the terminal C accommodated in the terminal accommodation chamber 12 and one pair of holder side walls 32 and 32 allowed to stand upright in both side end parts of the holder bottom wall 31 and having the engagement protrusions 32*a* formed which are engaged with the engagement holes 13*b* of the engagement wall parts 13*a*.

Further, the rear holder 30 adjusts a width in the fitting direction so that a rear end surface 30*a* is flush with a rear end surface 13*c* of the housing side engagement part 13 under a state that the rear holder 30 is connected to the connector housing 10 at the position of the rear end side in the fitting direction.

More specifically, the rear holder 30 adjusts the width in the fitting direction so that the rear end surface 30*a* is flush with the rear end surfaces 13*c* of the one pair of engagement wall parts 13*a* and 13*a* under a state that the rear holder 30 is connected to the connector housing 10 at the position of the rear end side in the fitting direction.

Namely, since the rear holder 30 is adjusted so as not to protrude rearward in the fitting direction as much as possible, even when a width in the fitting direction in the rear extending part 20 is suppressed to be small as much as possible, the rear extending part 20 can be adjusted so that the rear extending part 20 may protrude more rearward than the rear holder 30.

The rear holder 30 is connected to the connector housing 10 through a hinge part 40, so that the rear holder 30 can be rotated to an engaged position and an engagement releasing position to the connector housing 10.

Now, by referring to FIGS. 6A, 6B, and 6C, will be described a procedure that the terminal c of the electric wire CW having the terminal is inserted into the terminal accommodation chamber 12 of the connector housing 10

Figure 6A:
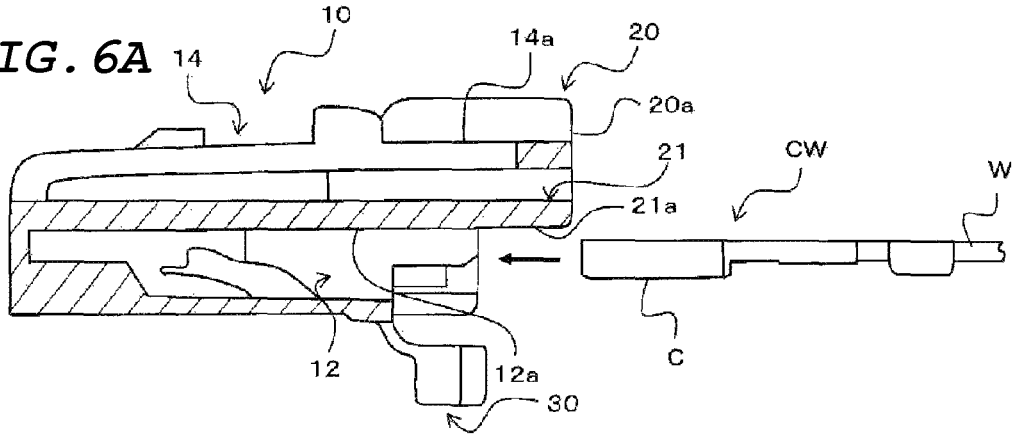
FIGS. 6A, 6B, and 6C are explanatory views which explain a procedure for inserting the terminal of the electric wire having the terminal into a terminal accommodation chamber of the connector housing.
Figure 6B:
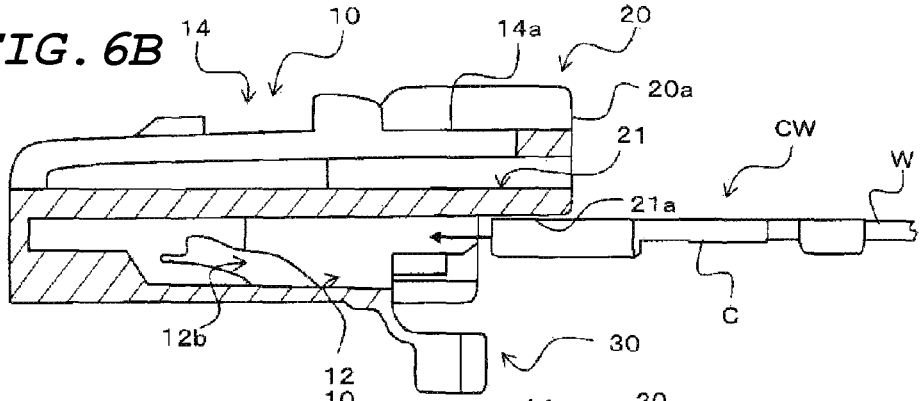
Figure 6C:
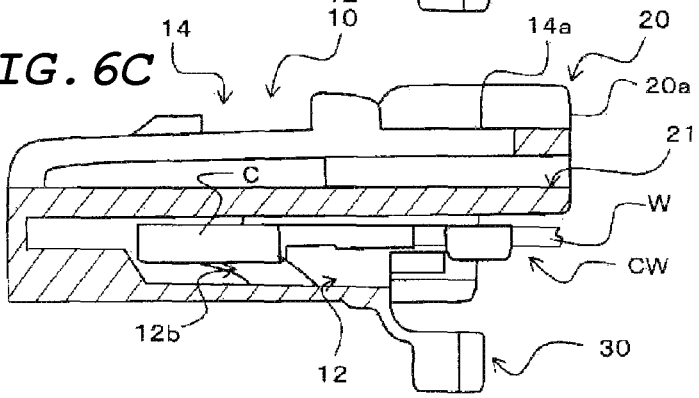

FIGS. 6A, 6B, and 6C are explanatory views which explain a procedure for inserting the terminal C of the electric wire CW having the terminal into the terminal accommodation chamber 12 of the connector housing 10.

Initially, an operator begins to move the terminal C of the electric wire CW having the terminal toward the corresponding terminal insert opening 11*f* of the terminal accommodation chamber 12 (FIG. 6A).

At this time, the terminal C can be easily guided to the terminal insert opening 11*f* by the terminal guide surface 21*a* of the extending wall 21 protruding more rearward in the fitting direction than the terminal insert opening 11*f*.

Further, since the elastic engagement arm 14 is provided in the back side to the terminal guide surface 21*a* of the extending wall 21, the electric wire W of the electric wire CW having the terminal is prevented from coming into contact with the elastic engagement arm 14.

In such a way, the terminal C guided to the terminal accommodation chamber 12 by the terminal guide surface 21*a* is engaged with the engagement lance 12*b*, so that the terminal C is engaged in the prescribed position in the terminal accommodation chamber.

Further, after the operator accommodates the terminals C respectively in the terminal accommodation chambers 12, the operator connects the rear holder 30 to the connector housing 10. Thus, the terminals C are double engaged in the prescribed positions in the terminal accommodation chambers 12.

Now, by referring to FIGS. 7A and 7B, a procedure will be described below that the connector 1 is fitted to the mate connector 100.

Figure 7A:
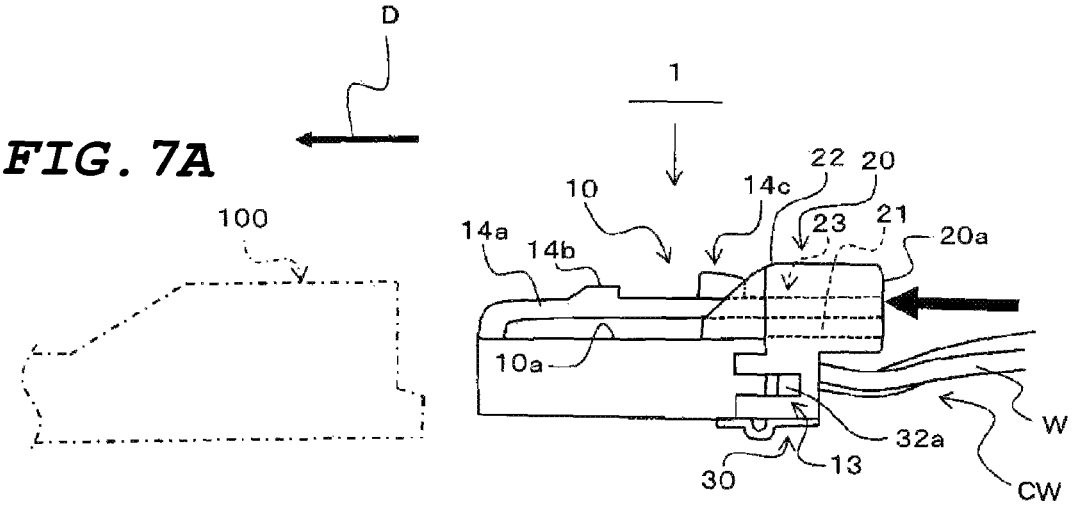
FIG. 7A is a diagram showing a state that a rear end surface for a pressing operation of a rear extending part is pressed to move the connector in the fitting direction.
Figure 7B:
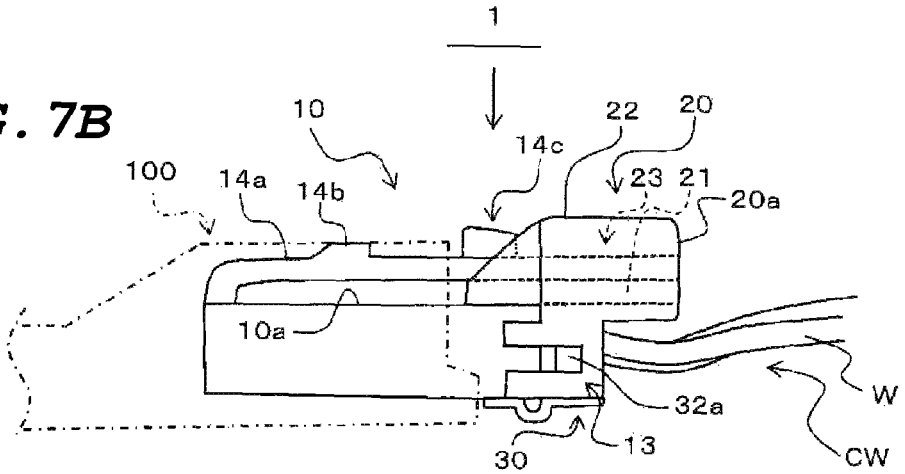
FIG. 7B is a diagram showing a state that the connector is fitted to the mate connector.

FIG. 7A is a diagram showing a state that the rear end surface 20*a* for the pressing operation of the rear extending part 20 is pressed to move the connector 1 in the fitting direction D. FIG. 7B is a diagram showing a state that the connector 1 is fitted to the mate connector 100. In FIGS. 7A and 7B, an outer configuration of the mate connector 100 is shown by a virtual line.

Initially, the operator presses the rear end surface 20*a* for the pressing operation of the rear extending part 20 to begin to move the connector 1 in the fitting direction D (see FIG. 7A).

Here, since the rear end surface 20*a* for the pressing operation is formed in a position protruding more rearward than the rear holder 30 connected to the connector housing 10, even when an operation space for fitting the connector is narrow, the operator can easily press the connector 1 in the fitting direction by using a jig or the like.

Further, since the rear end surface 20*a* for the pressing operation is formed in a position where the rear end surface 20*a* for the pressing operation hardly interferes with the electric wire W of the electric wire CW having the terminal, the operator can easily press the connector 1 in the fitting direction D by using the jig or the like so that the electric wire W does not interfere with the connector.

Further, since the rear end surface 20*a* for the pressing operation protrudes more rearward in the fitting direction than the rear holder 30 from the position which shifts substantially in the direction intersecting at right angles to the fitting direction D relative to the housing side engagement part 13, when an external force in the fitting direction D is applied to the rear end surface 20*a* for the pressing operation, the external force is hardly applied to the engaged part of the connector housing 10 and the rear holder 30.

After that, the operator moves the connector 1 in the fitting direction D to a position where the elastic engagement arm 14 is completely engaged with the mate connector 100 to fit the connector 1 to the mate connector 100, so that the operator finishes the operation.

Now, by referring to FIGS. 8A and 8B, and FIGS. 9A and 9B, a procedure will be described below that a fitted state of the mate connector 100 and the connector 1 is released.

Figure 8A:
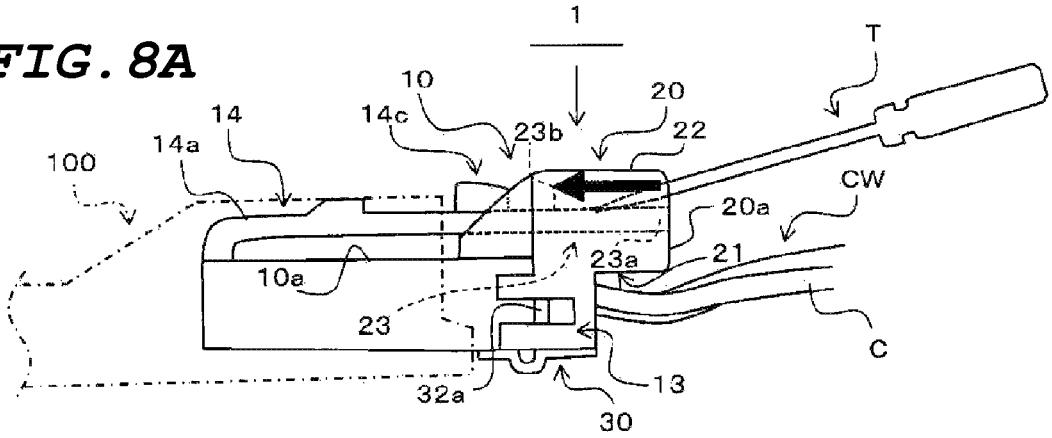
FIG. 8A is a diagram showing a state that an end of an engagement releasing jig is allowed to come into contact with and slide on a jig guide surface and moved toward a jig insert hole of an engagement releasing operation part.
Figure 8B:
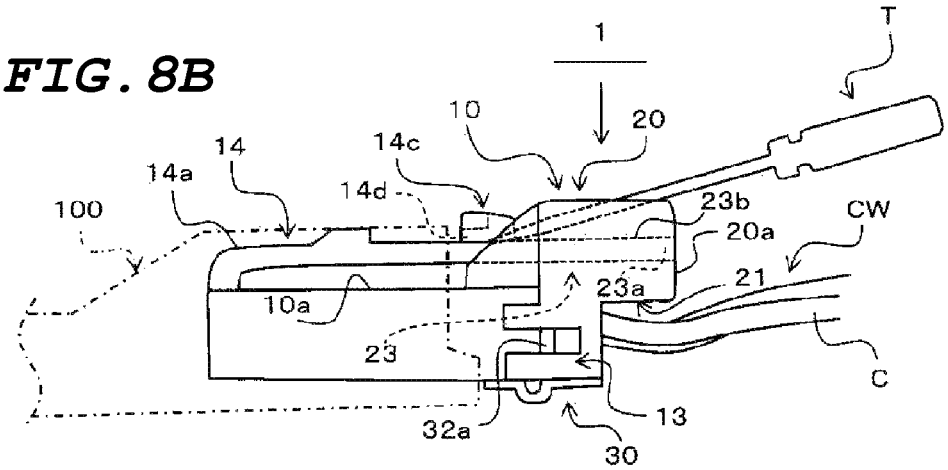
FIG. 8B is a diagram showing a state that the end of the engagement releasing jig is inserted into the jig insert hole of the engagement releasing operation part.
Figure 9A:
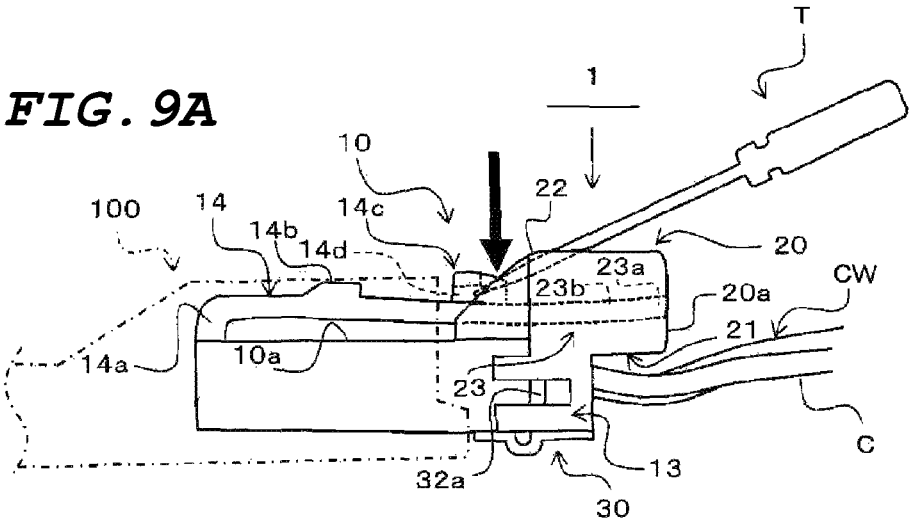
FIG. 9A is a diagram showing a state that a peripheral part of the engagement releasing operation part is bent by the engagement releasing jig to release an engagement with the mate connector by an elastic engagement arm.
Figure 9B:
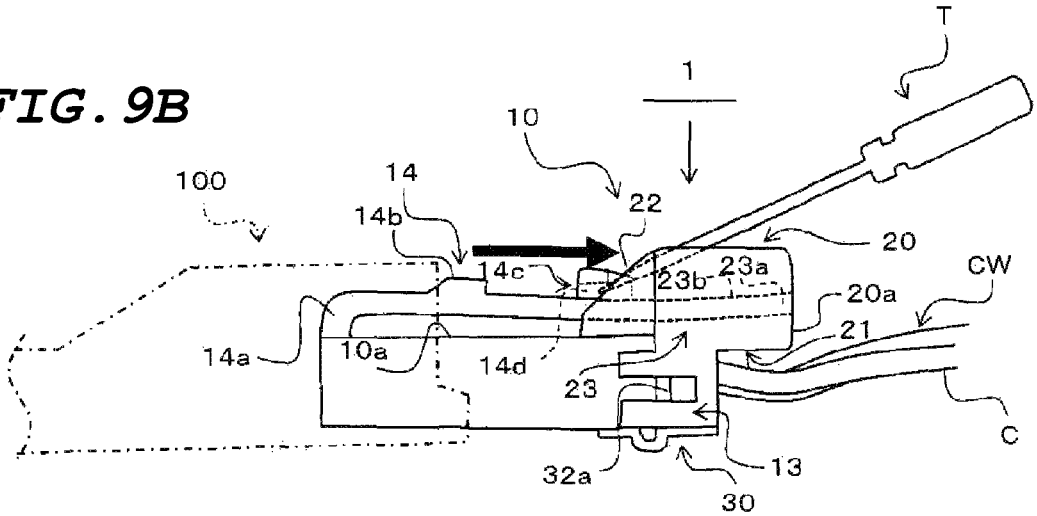
FIG. 9B is a diagram showing a state that the connector disengaged from the mate connector is moved in an opposite direction to the fitting direction.

FIG. 8A is a diagram showing a state that an end of the engagement releasing jig T is allowed to come into contact with and slide on the jig guide surface 23*b* and moved toward the jig insert hole 14*d* of the engagement releasing operation part 14*c*. FIG. 8B is a diagram showing a state that the end of the engagement releasing jig T is inserted into the jig insert hole 14*d* of the engagement releasing operation part 14*c*. FIG. 9A is a diagram showing a state that a peripheral part of the engagement releasing operation part 14*c* is bent by the engagement releasing jig T to release an engagement with the mate connector 100 by the elastic engagement arm. FIG. 9B is a diagram showing a state that the connector 1 disengaged from the mate connector 100 is moved in an opposite direction to the fitting direction D.

In FIGS. 8A and 8B, and FIGS. 9A and 9B, the outer configuration of the mate connector 100 is shown by a virtual line.

In the present exemplary embodiment, as the engagement releasing jig T used for a releasing operation of the engagement with the mate connector 100, a minus driver is used. However, as the engagement releasing jig T is not limited to the minus driver and other jig may be used.

Initially, the operator allows the end of the engagement releasing jig T to come into contact with and slide on the jig guide surface 23*b* and moves the engagement releasing jig T toward the jig insert hole 14*d* of the engagement releasing operation part 14*c* (see FIG. 8A).

Here, the operator can guide and move the end of the engagement releasing jig T on the jig guide surface 23*b* toward the jig insert hole 14*d* of the engagement releasing operation part 14*c* from the rear end of the rear extending part 20 protruding rearward in the fitting direction.

After that, when the operator inserts the end of the engagement releasing jig T into the jig insert hole 14*d* of the engagement releasing operation part 14*c* (see FIG. 8B), the operator bends the periphery of the engagement releasing operation part 14*c* by the engagement releasing jig T to release the engagement of the mate connector with the elastic engagement arm 14 (see FIG. 9A).

Here, when the operator operates the engagement releasing jig T whose end is inserted into the jig insert hole 14*d* so as to bend the elastic engagement arm 14 toward the top wall 11*b*, the engagement protrusion 14*b* moves so as to release an engagement with an engaged part of the mate connector 100 not shown in the drawing, so that the engagement of the connector 1 and the mate connector 100 is released.

Finally, the operator moves the connector 1 whose engagement with the mate connector 100 by the elastic engagement arm 14 in an opposite direction to the fitting direction D to finish the operation (see FIG. 9B).

In the connector 1 according to the exemplary embodiment of the present invention, since the rear end surface 20*a* for the pressing operation protrudes more rearward in the fitting direction than the rear holder 30 connected to the connector housing 10 from the position which shifts substantially in the direction intersecting at right angles to the fitting direction D relative to the housing side engagement part 13, when the external force in the fitting direction D is applied to the rear end surface 20*a* for the pressing operation, the external force is hardly applied to the engaged part of the connector housing 10 and the rear holder 30. Thus, when the connector 1 is pushed in the fitting direction D, the engaged part of the connector housing 10 and the rear holder 30 can be prevented from being broken. Further, since the electric wire W of the electric wire CW having the terminal can be prevented from coming into the elastic engagement arm 14 and the terminal C can be guided to the terminal accommodation chamber 12 from the rear end surface 20*a* side for the pressing operation by the terminal guide surface 21*a* at the same time, the elastic engagement arm 14 as the engaged part of the mate connector 100 and the engaged part of the connector housing 10 and the rear holder 30 can be prevented from being broken. Further, the terminal C can be smoothly inserted into the terminal accommodation chamber 12.

Further, the connector 1 according to the exemplary embodiment of the present invention can provide both a function of preventing the electric wire W from coming into contact with the elastic engagement arm 14 by the extending wall 21 which has the inner wall surface 12*a* of the terminal accommodation chamber 12 extending rearward in the fitting direction and a guide function of the terminal C. Further, since the end of the engagement releasing jig T can be guided by and moved on the jig guide surface 23*b* toward the jig insert hole 14*d* of the engagement releasing operation part 14*c* from the rear end of the rear extending part 20 protruding rearward in the fitting direction, an operation for releasing the engagement of the mate connector 100 with the elastic engagement arm 14 can be easily carried out by the engagement releasing jig T.

Further, in the connector 1 according to the exemplary embodiment of the present invention, since the walls which form the rear end surface 20*a* for the pressing operation are provided on the back side surface to the terminal guide surface 21*a* of the extending wall 21. Thus, since the rear end surface 20*a* for the pressing operation is formed in the position where the rear end surface 20*a* for the pressing operation hardly interferes with the electric wire W of the electric wire CW having the terminal, the connector 1 can be easily pressed in the fitting direction D so that the electric wire W does not interfere with the connector.

Further, in the connector 1 of the exemplary embodiment of the present invention, the rear extending part 20 provides the rear end surface 20*a* for the pressing operation which is formed with a wall having a square shape in section by the extending wall 21, the one pair of reinforcing ribs 22 and 22 and the extending end 23*a*. Since the wall forming the rear end surface 20*a* for the pressing operation has a structure high in its rigidity, the connector 1 can be pressed in a stable manner in the fitting direction.

Further, in the connector 1 according to the exemplary embodiment of the present invention, the rear holder 30 adjusts the width in the fitting direction D so that the rear end surface 30*a* is flush with the rear end surface 13*c* of the housing side engagement part 13 under a state that the rear holder 30 is connected to the connector housing 10 at the position of the rear end side in the fitting direction. Thus, since the rear holder 30 is adjusted so as not to protrude rearward in the fitting direction as much as possible, even when a width in the fitting direction in the rear extending part 20 is suppressed to be small as much as possible, the rear extending part 20 can be adjusted so that the rear extending part 20 may protrude more rearward than the rear holder 30. As a result, an increase of the width of the connector 1 in the fitting direction D can be suppressed to be small as much as possible and the rear extending part 20 can be adjusted so as to protrude more rearward in the fitting direction than the rear holder 30.

As the connector according to the exemplary embodiment of the present invention, the connector is exemplified in which the rear holder 30 is connected to the connector housing 10 through the hinge part 40. However, the connector is not limited to the structure that the rear holder 30 is connected to the connector housing 10. For instance, a structure may be used in which a rear holder 30 is provided separately from a connector housing 10.

The invention devised by the inventor is specifically explained above in accordance with the above-described exemplary embodiment of the invention, however, the present invention is not limited to the above-described exemplary embodiment of the invention and the present invention may be variously changed within a range that does not deviate from the gist thereof.

DESCRIPTION OF REFERENCE NUMERALS AND SIGNS

1 . . . connector 10 . . . connector housing 10*a* . . . outer surface 11 . . . housing main body part 11*a* . . . bottom wall 11*b* . . . top wall 11*c* . . . side wall 11*d* . . . partition wall 11*e* . . . mate terminal insert opening 11*f* . . . terminal insert opening 12 . . . terminal accommodation chamber 12*a* . . . inner wall surface 12*b* . . . engagement lance 13 . . . housing side engagement part 13*a* . . . engagement wall part 13*b* . . . engagement hole 14 . . . elastic engagement arm 14*a* . . . elastic arm 14*b* . . . engagement protrusion 14*c* . . . engagement releasing operation part 14*d* . . . jig insert hole 20 . . . rear extending part 20*a* . . . rear end surface for pressing operation 21 . . . extending wall 21*a* . . . terminal guide surface 22 . . . reinforcing rib (wall) 23 . . . jig guide part 23*a* . . . extending end 23*b* . . . jig guide surface 24 . . . wall 30 . . . rear holder 30*a* . . . rear end surface 31 . . . holder bottom wall 31*a* . . . terminal pressing surface 32 . . . holder side wall 32*a* . . . engagement protrusion (holder side engagement part) 40 . . . hinge part 100 . . . mate connector CW . . . electric wire having terminal C . . . terminal W . . . electric wire

What is claimed is:

1. A connector comprising:

a connector housing including an elastic engagement arm as a part to be engaged with a mate connector serving which is a mate to which the connector is fitted, a terminal accommodation chamber which accommodates therein a terminal of an electric wire having the terminal, and a housing side engagement part, and a rear holder including a holder side engagement part engaged with the housing side engagement part so as to be connected to the connector housing at a position of a rear end side in a fitting direction to the mate connector, wherein the connector housing includes a rear extending part having a rear end surface and a terminal guide surface, wherein the rear end surface is possible to be pressed toward the fitting direction and always protrudes more rearward in the fitting direction than the rear holder from a position which shifts in a direction intersecting at substantially right angles to the fitting direction relative to the housing side engagement part, and wherein the terminal guide surface is configured to prevent the electric wire from coming into contact with the elastic engagement arm and guides the terminal to the terminal accommodation chamber from a side of the rear end surface.

2. The connector according to claim 1, wherein the rear extending part includes an extending wall which is extended rearward in the fitting direction from an inner wall surface of the terminal accommodation chamber, wherein the terminal guide surface is a surface continuous to the inner wall surface of the extending wall, wherein the elastic engagement arm includes an elastic arm and an engagement releasing operation part, wherein the elastic arm is formed in a back side to the terminal guide surface of the extending wall and protrudes in a shape of an arm on an outer surface of the connector housing so as to direct an end forward in the fitting direction, wherein the engagement releasing operation part includes a jig insert hole formed in the elastic arm in which an engagement releasing jig is inserted in order to elastically bend the elastic arm and release an engagement to the mate connector, and wherein the rear extending part includes a jig guide part having a jig guide surface which is made from an extension part which extends the elastic arm more rearward from the engagement releasing operation part in the fitting direction and which guides the engagement releasing jig from the rear end surface to the jig insert hole.

* * * * *